US007059384B2

(12) United States Patent
Bouchard et al.

(10) Patent No.: US 7,059,384 B2
(45) Date of Patent: Jun. 13, 2006

(54) APPARATUS AND METHOD FOR METAL STRIP CASTING

(75) Inventors: Dominique Bouchard, Montreal (CA); Jean-Paul Nadeau, Sorel-Tracy (CA); Francois Hamel, Boucherville (CA); Daniel Simard, Vercheres (CA); Serge F. Turcotte, Boucherville (CA)

(73) Assignee: National Research Council of Canada, Ottawa (CA)

( * ) Notice: Subject to any disclaimer, the term of this patent is extended or adjusted under 35 U.S.C. 154(b) by 0 days.

(21) Appl. No.: 10/170,427

(22) Filed: Jun. 14, 2002

(65) Prior Publication Data

US 2003/0015309 A1 Jan. 23, 2003

Related U.S. Application Data

(60) Provisional application No. 60/298,100, filed on Jun. 15, 2001.

(51) Int. Cl.
*B22D 11/00* (2006.01)

(52) U.S. Cl. ..... 164/480; 164/479

(58) Field of Classification Search ..... 164/480, 164/459, 463, 479
See application file for complete search history.

(56) References Cited

U.S. PATENT DOCUMENTS

| | | | | |
|---|---|---|---|---|
| 3,771,586 | A * | 11/1973 | Waring | 164/258 |
| 4,705,095 | A * | 11/1987 | Gaspar | 164/463 |
| 4,887,662 | A | 12/1989 | Tanaka et al. | 164/427 |
| 5,103,895 | A | 4/1992 | Furuya et al. | 164/475 |
| 5,417,772 | A * | 5/1995 | Bavay et al. | 148/110 |
| 5,520,243 | A | 5/1996 | Freeman et al. | 164/478 |
| 5,584,338 | A | 12/1996 | Freeman et al. | 164/478 |
| 5,590,703 | A * | 1/1997 | Eckert | 164/476 |
| 5,701,948 | A | 12/1997 | Strezov et al. | 164/480 |
| 5,720,336 | A | 2/1998 | Strezov | 164/480 |
| 5,964,277 | A | 10/1999 | Tanaka et al. | 164/480 |

OTHER PUBLICATIONS

"Control of heat transfer and growth uniformity of solidifying copper shells through substrate temperature", D. Bouchard et al. pp. 1-19.
"Twin-roll strip casting of carbon steel".

* cited by examiner

*Primary Examiner*—Len Tran
(74) *Attorney, Agent, or Firm*—Marks & Clerk; Richard J. Mitchell

(57) ABSTRACT

Disclosed is a method and apparatus for continuously casting a metal strip. A casting pool of molten metal is formed, and a metal strip is solidified onto a casting surface. The temperature of the casting surface is maintained above a predetermined critical value. By maintaining the surface temperature above the predetermined critical value, either the heat transfer uniformity or the heat transfer capacity or both are improved.

13 Claims, 5 Drawing Sheets

30°C 350°C

T < 200°C T > 200°C

APPARATUS AND METHOD FOR METAL STRIP CASTING

CROSS-REFERENCE TO RELATED APPLICATION

This application claims the benefit of U.S. Provisional Application No. 60/298,100 filed Jun. 15, 2001, incorporated by reference herein.

FIELD OF THE INVENTION

The present invention relates to the casting of metal.

BACKGROUND OF THE INVENTION

It is known that a metal strip can be cast by continuous casting in a twin roll caster. Molten metal is introduced between a pair of counter-rotating horizontal casting rolls which are cooled so that metal shells solidify on the moving roll surfaces and are brought together at the region where the rolls are closest together, referred to as the nip, between them to produce a solidified strip product delivered downwardly from the nip between the rolls. The molten metal may be introduced into the nip between the rolls via a tundish and a metal delivery nozzle located beneath the tundish so as to receive a flow of metal from the tundish and to direct it into the nip between the rolls, so forming a casting pool of molten metal supported on the casting surfaces of the rolls immediately above the nip. This casting pool may be confined between side plates or dams held in sliding engagement with the ends of the rolls. To make sheet metal, alloys are cast directly into strips to reduce the amount of hot rolling that thicker products require. In this process, a high rate of heat extraction from the strip to the rolls is desired to maximize productivity. At the same time, heat extraction must be uniform over the entire surface area of the strip to minimize stresses that induce surface cracks.

However, the interface between the rolls and the metal is the dominant resistance to heat flow (see for example Y. Kim, B. Farouk, and J. Keverian: *Journal of Engineering for Industry,* 1991, vol. 113, pp. 53–58) and many defects are produced here during the initial contact between the molten metal and the mold (see for example H. Yasunaka, K. Taniguchi, M. Kokita, and T. Inoue: *Iron Steel Inst. Jpn. Int.,* 1995, vol. 35, pp. 784–89). The condition of the rolls that act as the mold is determinant in the characteristics of this interface and may need to be tailored to the specific needs of the alloy that is cast. In particular, the temperature of the water cooled rolls is a feature of the process that may be properly adjusted to assist in achieving the desired solidification. The rotation of the rolls produces temperature cycles with a rise when contact of the solidifying metal with the rolls prevails and a fall when it ceases. For stainless steel strips solidifying on copper rolls, the surface temperature has been cited to cycle between approximately 200 to 400° C. (see for example F. Macci and A. Mollo: *La Revue de Métallurgie-CIT,* 1995, vol. 92, pp. 789–794). With steel rolls, the temperature cycles for the same alloy were between 400 and 800° C. (see for example F. Macci and A. Mollo: *La Revue de Métallurgie-CIT,* 1995, vol. 92, pp. 789–794). Tests performed by some of the present inventors using a prototype caster to produce carbon steel strip on nickel plated copper rolls yielded subsurface temperature cycles between 100 and 200° C. Temperature cycles have also been observed in single roll strip casting (see for example G. Li and B. G. Thomas: *Met. Mat. Trans.,* 1996, vol. 27B, pp. 509–525).

Several patents have addressed the issue of heat transfer intensity and uniformity in strip casting. U.S. Pat. No. 4,887,662 issued to Tanaka et al. teaches that improvement in surface quality is accomplished by reducing the heat extraction capacity of the rolls. This decrease in productivity is achieved by machining dimples (0.1–1.2 mm in diameter and 5–100 μm deep) at the surface of the rolls. The slow cooling approach to improve surface quality is also disclosed in U.S. Pat. No. 5,103,895, issued to Furuya et al. and U.S. Pat. No. 5,964,277 issued to Tanaka et al. which offer alternative methods to reduce heat extraction.

Other patents disclose methods of increasing the heat transfer capacity of the rolls to increase productivity. In U.S. Pat. No. 5,701,948 issued to Strezov et al. grooves of specific depth and spacing are machined at the surface of the rolls. However, designing dimples, grooves or any other specific pattern at the surface of the rolls requires vigilant maintenance since dimensional changes occur through usage. In U.S. Pat. No. 5,720,336 issued to Strezov it is claimed that an infiltration of a thin layer, less than 5 μm, of molten oxide at the interface between the rolls and the strip will improve the overall interfacial contact and hence heat transfer. However, with the infiltration of a molten oxide at the interface between the rolls and the strip, the composition and the thickness of that layer must be carefully controlled. Since the layer is likely made in-situ from chemical elements found in steel, this method is difficult to apply to the wide range of compositions found in commercial steels and generally cannot be applied to non-ferrous alloys.

The prior art does not discuss the effects of these methods on the surface quality of strips, which depends more on the uniformity of the heat flow than its intensity. To the present, the effect of the roll temperature on the heat transfer and the surface quality of strips has not been reported. In addition, the prior art does not address the issue of simultaneously increasing heat transfer intensity and uniformity.

SUMMARY OF THE INVENTION

The inventive method and apparatus aim to increase the heat transfer uniformity or heat transfer capacity of the process, or both, by maintaining the surface temperature of the rolls above a critical value.

The invention provides a method of continuously casting a metal strip, comprising the steps of providing a pool of molten metal, providing a casting surface, contacting molten metal with said casting surface to solidify a metal strip, and maintaining a surface temperature for said casting surface above a critical temperature for heat transfer efficiency.

The invention also provides an apparatus for continuously casting a metal strip, comprising casting pool forming equipment for providing a casting pool of molten metal, at least one casting surface for contacting the molten metal to solidify a metal strip, and a surface temperature controller for maintaining a casting surface temperature above a predetermined critical temperature for heat transfer efficiency.

It has been experimentally demonstrated that maintaining the roll surface temperature above a critical value can either increase the heat transfer intensity or the uniformity of the heat transfer or both. For example, with strip casting of copper, productivity improvements of 20% or more, and specifically between 25 and 30%, are provided, while those in uniformity are 35% when the surface roll temperature is maintained above 200° C. It has been shown that either productivity or quality, or both, are improved through the control of a single process parameter.

Surface temperature control can be achieved, for example, by controlling the cooling system of the casting rolls. A surface temperature controller can also be used and may include a heater in any form, for example an electrical heater, for heating the surface of the casting roll, when required, to maintain the temperature of the surface above the critical temperature. The apparatus can be a single or double roll configuration, or belt configuration, and can be any suitable orientation including vertical, horizontal or inclined. Any suitable metal, both ferrous and non-ferrous irrespective of composition, can be cast into strips using the apparatus. For copper, the critical temperature is about 200° C., and preferably the surface temperature is about 200 to about 350° C.

Controlling the surface temperature of a casting roll provides either the advantage of high productivity by way of thick skins of metal forming on each casting roll in the molten metal pool as the roll turns or high quality metal, as determined from the degree of smoothness observed, or both. Mechanical properties are improved, either from the microstructure of metal produced, or improved uniformity in the thickness of the product, or both.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein.

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like specifically recited herein.

DETAILED DESCRIPTION OF THE PREFERRED EMBODIMENTS

While this invention is described in terms of a twin roll casting apparatus used to form a copper sheet of metal, one skilled in the art will understand that the apparatus can be a single roll, double roll or belt configuration, and that both ferrous and non-ferrous metals can be used in accordance with the teachings of the present invention.

Preface

The following is a description of the numerical analysis used to determine the heat transfer between the metal and the rolls during the casting process, and subsequently the critical temperature of the substrate. The first requirement is to determine the heat flux. It is possible to calculate the heat flux at the interface between the substrate and the solidifying metal. For this purpose, the following nomenclature is required:

| | |
|---|---|
| k | thermal conductivity (W $m^{-1}K^{-1}$) |
| t | time (s) |
| x | length (m) |
| C | heat capacity (kJ $kg^{-1}K^{-1}$) |
| T | temperature (K.) |
| ρ | density (kg $m^{-3}$) |

Calculation of the Heat Flux, q(t)

Transient heat flow that is mainly unidirectional is described by the following equation:

$$\frac{\partial}{\partial x}\left(k(T)\frac{\partial T}{\partial x}\right)=\rho C\frac{\partial T}{\partial t} \quad [1]$$

Using the appropriate boundary conditions and thermophysical properties of the substrate material, this equation is used to calculate the temperature evolution in the substrate. Explicit finite-difference expressions can be used in conjunction with a function-specification method to obtain the heat flux evolution at the interface between the substrate and the solidifying shell. For details on this calculation, see the paper "Control of Heat Transfer and Growth Uniformity of Solidifying Copper Shells Through Substrate Temperature" by D. Bouchard et al. published *Met. Mat. Trans.,* 2002, volume 32B, pp. 403–411, incorporated herein by reference.

Experimental Data

Figure 1A:
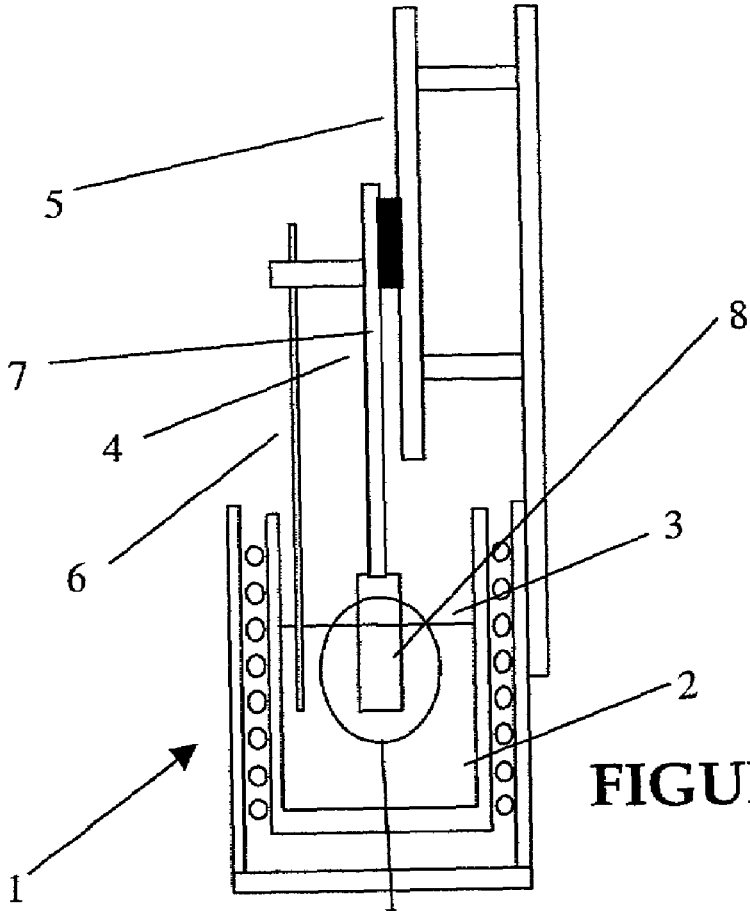
FIGS. 1*a* and 1*b* illustrate the experimental set-up with the chill block and thermocouple assembly.
Figure 1B:
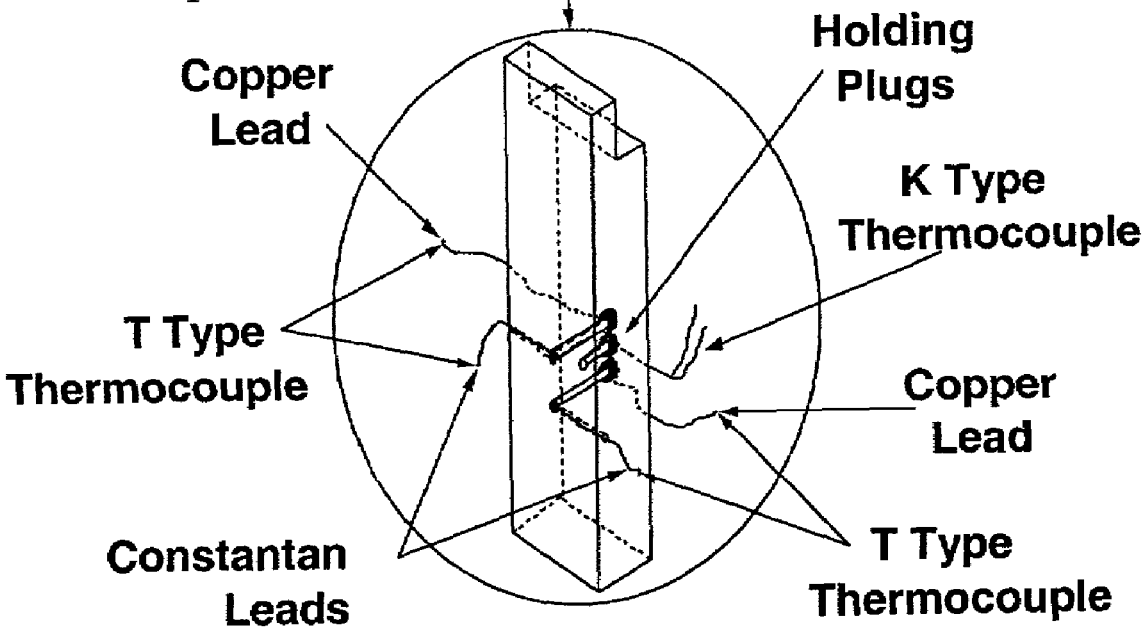

Heat transfer in strip casting is almost entirely unidirectional and important solidification conditions such as mold-metal contact time, mold velocity and entry angle in the pool can be fairly well simulated by dipping copper blocks in a bath of molten metal. FIGS. 1*a* and 1*b* illustrate a metal solidification test rig in which a chilled block is advanced into a bath of molten metal at such a speed as to closely simulate the conditions at the casting surfaces of a twin roll caster. The molten metal solidifies onto the chilled block to produce a layer of solidified metal on the surface of the block. The thickness of this layer can be measured at points throughout its area to map variations in the solidification rate and therefore the effective rate of heat transfer at the various locations. It is thus possible to produce an overall solidification rate as well as total heat flux measurements. It is also possible to examine the microstructure of the strip surface to correlate changes in the solidification microstructure with the changes in observed solidification rates and heat flux values.

The experimental rig illustrated in FIGS. 1*a* and 1*b* comprise an induction furnace 1 containing a melt of molten metal 2 in an inert atmosphere 3. An immersion paddle denoted generally as 4 is mounted on a slider 5 which can be advanced into the liquid metal 2 at a chosen speed and subsequently retracted by the operation of computer controlled motors (not shown). There is also a contact rod 6.

Immersion paddle 4 comprises a steel beam 7 which supports a substrate 8 in the form of a copper block of 50 mm in width, 120 mm in length and 20 mm in thickness. It is instrumented with thermocouples to monitor the temperature rise in the substrate which provide input data to obtain the heat flux.

The experiments were all carried out with blocks polished with abrasive paper, down to a 600 grit, producing an arithmetic mean roughness of approximately 0.5 μm. Unidirectional heat flow through the blocks was provided by insulating their sides, bottoms and backs.

The liquid metal bath consisted of approximately 40 kg of electrolytic tough pitch, ETP, copper (purity of 99.9+ percent). A positive pressure of nitrogen gas was maintained above it to prevent oxidation. All experiments were carried out at a liquid metal temperature of 1115±5° C. The blocks entered the bath at 40 mm $s^{-1}$, resided 0.5 s and exited at 40 mm $s^{-1}$. The residence time of the block was controlled within ±0.05 s of the set value by the contact rod depicted in FIG. 1*a*. The entry temperature of the blocks varied between 25 and 350° C. This range was obtained by simply dipping a block in the bath for two to three seconds and allowing to cool to the desired level. This strategy also produced a temperature distribution that was quite uniform. The gradient in a given block was 2 to 3° C./cm.

After the block exited the bath, the copper shell that had solidified onto its surface was detached and quenched in water. It was normally between 100 and 110 mm long. On average, four shells within this desired range were produced for each block temperature. Variations in the thickness of the shells were determined by drawing a grid and measuring the thickness at each line intersection with a vernier. A total of 28 thickness measurements were made on each shell to evaluate the standard deviation of the mean.

Figure 2:
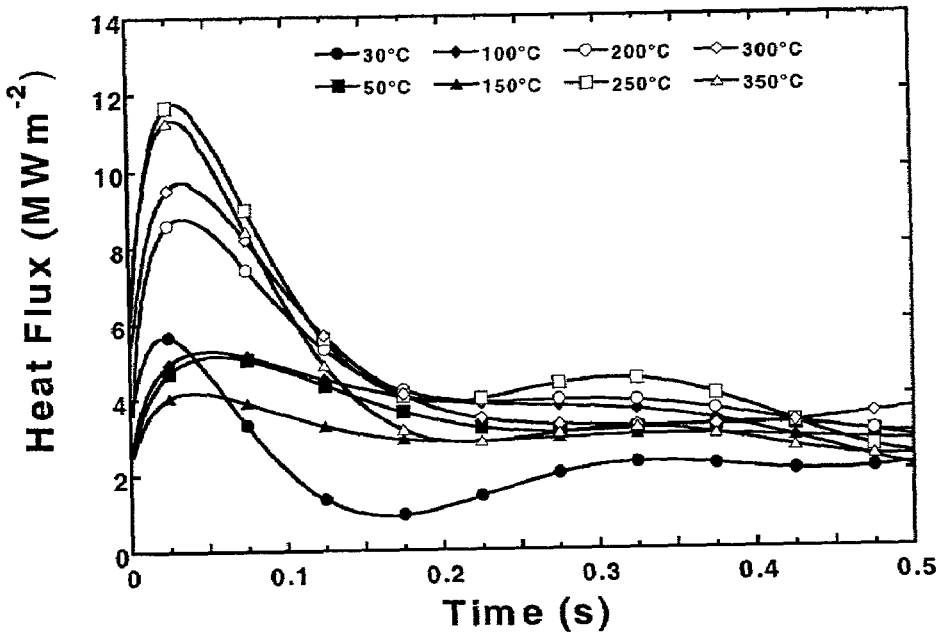
FIG. 2 illustrates heat flux as a function of time for substrates heated between 30 and 350° C.

The heat transfer occurring during the immersion was characterized as well as the surface condition and the microstructure of the shells that solidified onto its surface. The evolution of the heat flux at the interface between the substrate and solidifying metal is shown in FIG. 2 for the investigated substrate temperatures. Substrates heated in the range 30–150° C. produced peaks during the transient period that were significantly lower than those in the range 200–350° C.

Figure 3:
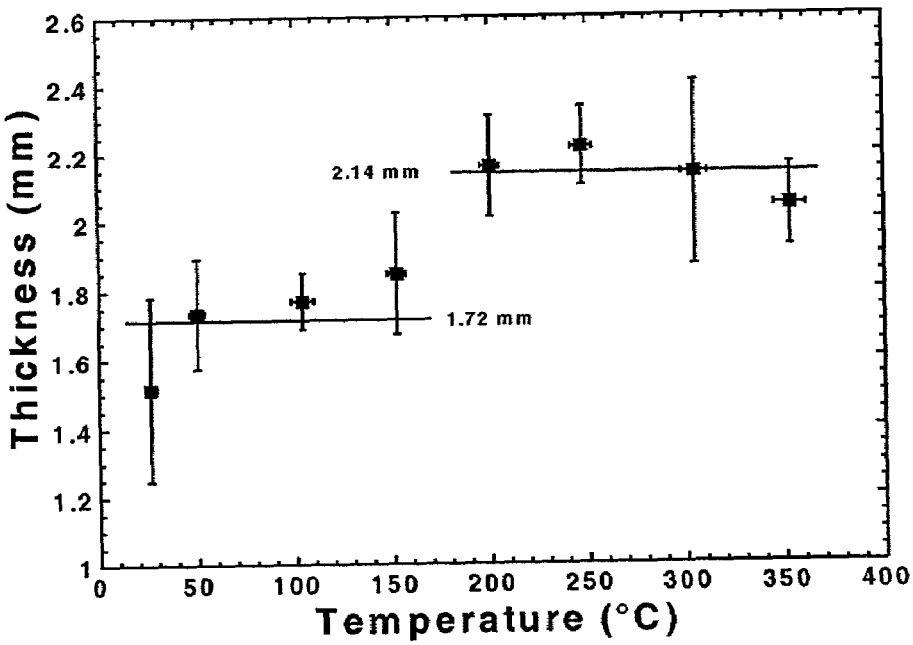
FIG. 3 illustrates average shell thickness produced on the heated substrate dipped into molten copper for 0.5 s, with error bars representing two standard deviations.

In FIG. 3, it is shown that shell thickness can also be grouped according to the same temperature ranges as those for the heat fluxes of FIG. 2. The results in these two Figures are consistent since the area below the heat flux curves represents the energy per unit of surface area that entered the substrates to solidify the shells. On average, shells produced with substrates heated above 200° C. are 20 percent thicker than those produced below this temperature. This represents a substantial productivity gain for a strip caster.

Figure 4:
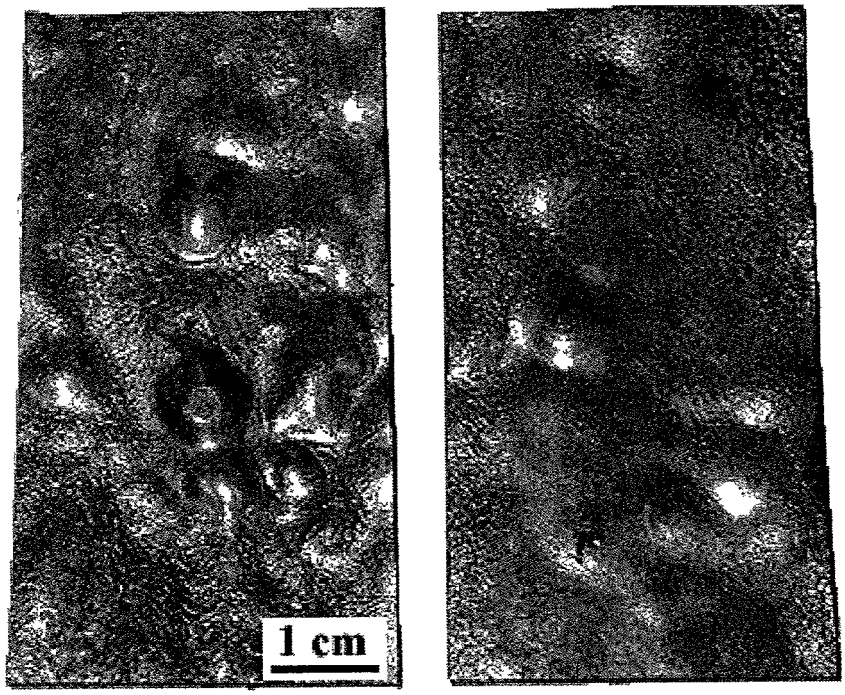
FIG. 4 illustrates morphologies of reverse sides of solidified shells for the lowest and highest investigated temperatures.
Figure 5:
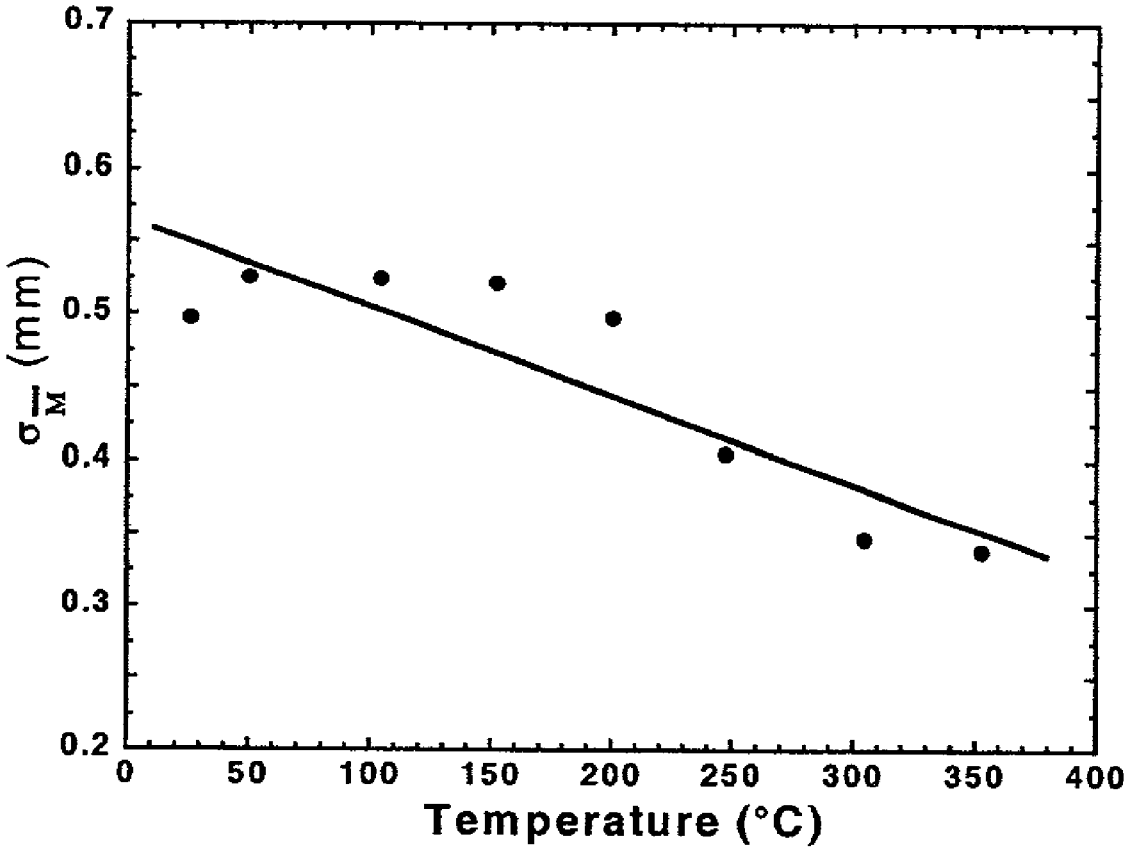
FIG. 5 illustrates effect of temperature on the degree of unevenness of shell growth as expressed by the standard deviation of the mean in the thickness of the shells, $\sigma_{\overline{M}}$.

The surface finish of the substrates was fairly well transferred to the shells. On average, the former had an arithmetic average roughness, $R_a$, of 0.5 μm compared to 1.5 μm for the latter. Varying the temperature from 25 to 350° C. did not significantly alter the rugosity of the shells, and a more uniform shell growth was produced by the substrate preheated at 350° C. As shown in FIG. 4, the reverse side of the shells was distinguished by the presence of localized bumps. These are an indication of an uneven solidification rate and have been reported in other studies dealing with the solidification of alloys of copper (see for example D. Bouchard, F. G. Hamel, J.-P. Nadeau, S. Bellemare, F. Dreneau, D. A. Tremblay, and D. Simard: *Met. Mat. Trans.,* 2001, volume 32B, pp. 111–118), aluminum (see for example D. A. Weirauch Jr and A. Giron: *The Integration of Material, Process and Product Design*, Zabaras et al. ed., Rotterdam, 1999, pp. 183–191), and steel (see for example Y. Shirai: *Camp-ISIJ,* 1989, vol. 2, p. 306). In twin roll casting, a uniform growth is desired to prevent cracks to develop in the strip when the two skins are fused together (see for example D. Bouchard, F. G. Hamel, J.-P. Nadeau, S. Bellemare, F. Dreneau, D. A. Tremblay, and D. Simard: *Met. Mat. Trans.,* 2001, volume 32B pp. 111–118), and to minimize thermal stresses. The degree of unevenness in the heat flow was determined from the variations in the thickness of the shells. FIG. 5 illustrates the effect of the substrate temperature on the variation of shell thickness. It is noted that an improvement in the thickness uniformity is produced by increasing the temperature of the substrate.

Figure 6:
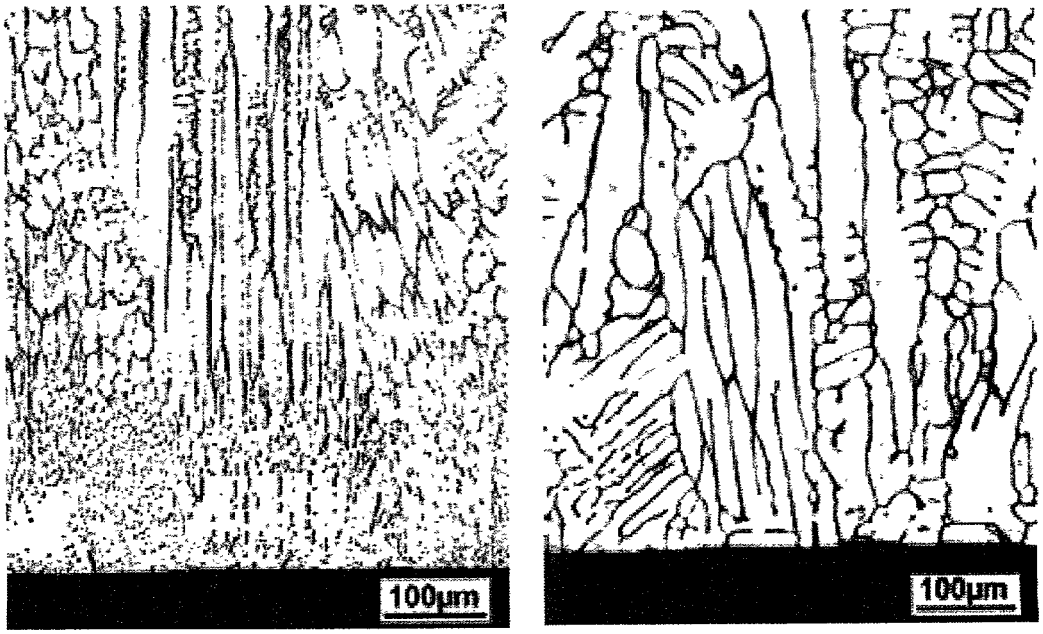
FIG. 6 illustrates characteristic microstructures of solidified shells produced by substrates preheated below and above 200° C.

FIG. 6 displays examples of the shell microstructures produced with substrates that were preheated below and above the transition temperature of 200° C. A significant refinement of dendrites was obtained with the latter treatment. Solidification proceeded from bottom to top and the bottom edges that are shown were in direct contact with the substrates, etched with a solution of equal volumes of $NH_4OH$, $H_2O$ and 3% $H_2O_2$. Secondary dendrite arms are often absent due to the high cooling rates and this is common in chill zones of ingots (see for example M. Flemings: *Solidification Processing*, McGraw-Hill, New York, N.Y., 1974, pp. 76 and 148). It is noted that the dendrites produced below 200° C. are coarser than those above this temperature and this corroborates with the results of FIG. 2 since dendrite spacing is inversely proportional to the cooling rate (see for example M. Flemings: *Solidification Processing*, McGraw-Hill, New York, N.Y., 1974, pp. 76 and 148) provided by the heat flux.

At the initiation of solidification of copper, the heat transferred to a copper substrate is improved by preheating the substrate. A sharp transition, where the peak value of the transient heat flux at the interface between a substrate and the solidifying shell approximately doubled, was obtained when the substrates were preheated above 200° C. The amelioration in heat transfer provided by preheating the substrate above the transition temperature resulted in a 20% increase in the thickness of solidified shells for a substrate immersion time of 0.5 s in the bath of molten copper. For a twin roll strip caster, this could yield a substantial increase in productivity that could be greater than 20%. Shell growth was also found to be more uniform with a high substrate preheat temperature. In twin roll strip casting, this would contribute to diminish the occurrence of cracks. Shells solidified on substrates with high preheat temperatures also displayed finer dendritic structures. Improved wetting between the metal and the substrate is considered to be the main factor that explains the effect of substrate temperature on solidification.

It has been experimentally demonstrated that maintaining the roll surface temperature above a critical value can either increase the heat transfer intensity or the heat transfer uniformity or both. For copper, the critical temperature is about 200° C., and preferably the surface temperature is about 200 to about 350° C. With strip casting of copper, productivity improvements greater than 20%, and specifically between 25 and 30%, are provided, while those in uniformity are 35%. It has been shown that productivity and quality are simultaneously improved through the control of a single process parameter.

The apparatus for carrying out the casting process can be a single or double roll configuration or belt configuration, and can be any suitable orientation including vertical, horizontal or inclined. Any suitable metal, both ferrous and non-ferrous irrespective of composition, can be cast into strips using the apparatus.

Figure 7:
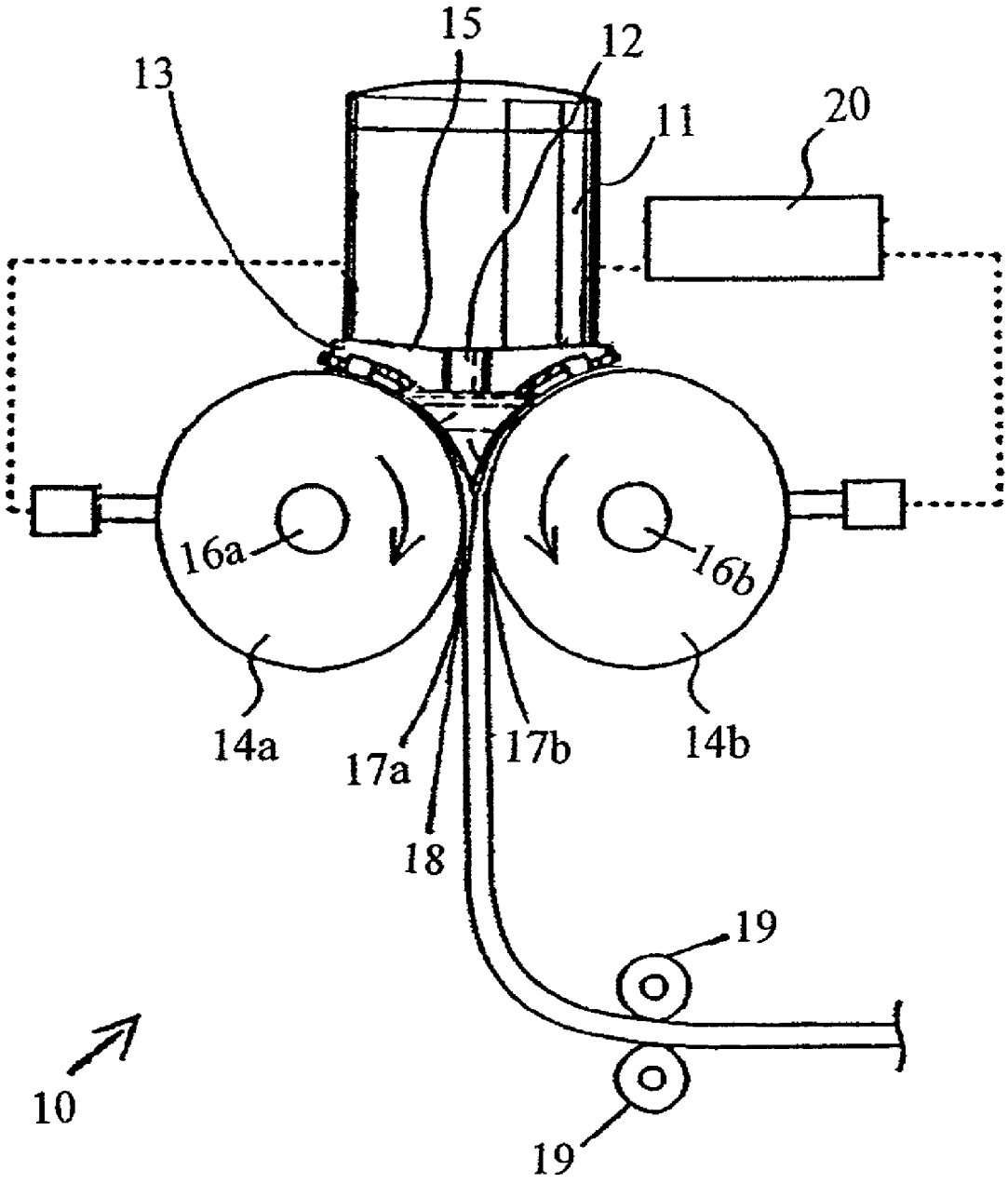
FIG. 7 illustrates an apparatus used in accordance with the present invention.

FIG. 7 shows a twin roll continuous casting machine 10 for casting metal, according to an embodiment of the present invention. A tundish 11 supplies molten metal through a metal delivery nozzle 12 to a pouring basin 13. The pouring basin 13 is formed by a pair of cooling drums 14*a*, 14*b*, and side walls 15. Casting roll drivers 16*a*, 16*b* rotate the rolls. In this example, the rolls 14*a*, 14*b* are counter-rotated. The molten metal solidifies on the casting surfaces 17*a*, 17*b* of the cooling drums 14*a*, 14*b* and moves downward as the cooling drums 14*a*, 14*b* rotate. Two solidified shells of the molten metal are bound together at a nip 18 to form a single cast metal sheet. The cast metal sheet comes out of the cooling drums 14*a*, 14*b*, forms a loop and advances toward pinch rolls 19. A surface temperature controller 20 (illustrated schematically) maintains the substrate surface temperature above the predetermined critical temperature depending on the metal being cast. Surface temperature control can also be achieved by control of cooling system of the casting roll. The surface temperature controller can be of any kind and include, for example a heater such as electric, induction, gas or laser, for heating the surface of the casting roll, when required, to maintain the temperature of the surface above the critical temperature.

Numerous modifications may be made without departing from the spirit and scope of the invention as defined in the appended claims.

What is claimed is:

1. A method of continuously casting a metal strip, comprising:

providing a pool of molten metal having wetting properties;

providing a casting surface;

determining a critical temperature for a substrate in contact with said metal, said critical temperature being defined as the temperature of said substrate at which, when said substrate is immersed in said molten metal, peak value of transient heat flux between said substrate and said molten metal undergoes a sharp transition due to an improvement in the wetting properties of said molten metal;

preheating said casting surface to a temperature above said critical temperature;

contacting molten metal from said pool with said casting surface to form a solidified metal strip; and continuously maintaining the surface temperature of said casting surface at a temperature above said critical temperature as said molten metal comes into contact with said casting surface; and wherein said metal is copper and the critical temperature is at least 200° C.

2. The method of claim 1, wherein the step of maintaining includes using a heater to heat the casting surface to a temperature above the critical temperature.

3. The method of claim 2, wherein the heater is an electric, induction, gas or laser heating device.

4. The method of claim 1, wherein the step of maintaining includes using a cooling system to control the surface temperature.

5. The method of claim 1, wherein said method is a vertical twin roll casting method, and said casting surface is provided by a pair of opposed horizontal rolls forming a nip between them and through which said metal passes.

6. A method as claimed in claim 1, wherein said casting surface is maintained at a temperature between 200 and 3500C.

7. The method of claim 6, wherein said critical temperature is identified by immersing said substrate in a bath of said molten metal, and monitoring the transient heat flux.

8. The method of claim 6, wherein said critical temperature is identified by immersing a plurality of said substrates in a bath of said molten metal at different temperatures for a predetermined period of time, and monitoring the thickness of deposited metal after removal from said bath.

9. A method of continuously casting a metal strip, comprising:

providing a pool of molten metal having wetting properties;

providing a cooling surface;

predetermining a critical temperature for a substrate in contact with said metal, said critical temperature being defined as the temperature of said substrate at which, when said substrate is immersed in said molten metal, the peak value of the heat flux at the interface between the substrate and the molten metal undergoes a sharp transition due to an improvement in the wetting properties of said molten metal;

contacting molten metal from said pool with said cooling surface to form a solidified metal strip thereon; and employing a surface temperature controller to continuously control the surface temperature of said cooling surface to be maintained at a temperature above said predetermined critical temperature as said molten metal comes into contact with said cooling surface.

10. A method as claimed in claim 9, wherein said surface temperature controller controls a cooling system for said cooling surface to maintain said surface temperature.

11. A method as claimed in claim 9, wherein said surface temperature controller controls heating of said cooling surface to maintain said surface temperature.

12. A method as claimed in claim 9, wherein said metal is copper and said critical temperature is above 200° C.

13. A method as claimed in claim 9, wherein said critical temperature is determined by dipping substrates preheated to different temperatures into said molten metal, and measuring the thickness of solidified metal after a predetermined residence time.

* * * * *

UNITED STATES PATENT AND TRADEMARK OFFICE

CERTIFICATE OF CORRECTION

PATENT NO. : 7,059,384 B2
APPLICATION NO. : 10/170427
DATED : June 13, 2006
INVENTOR(S) : Dominique Bouchard et al.

It is certified that error appears in the above-identified patent and that said Letters Patent is hereby corrected as shown below:

Col. 8 line 12
Claim 6, line 3: “3500C” should read -- 350°C --

Signed and Sealed this

Twenty-seventh Day of March, 2007

JON W. DUDAS
*Director of the United States Patent and Trademark Office*